US009955767B2

(12) United States Patent
Parekh

(10) Patent No.: US 9,955,767 B2
(45) Date of Patent: May 1, 2018

(54) CONNECTING ELEMENT WITH DUAL ENGAGING MEANS

(71) Applicant: PIDILITE INDUSTRIES LIMITED, Mumbai (IN)

(72) Inventor: Madhukar Balvantray Parekh, Mumbai (IN)

(73) Assignee: PIDILITE INDUSTRIES LIMITED, Mumbai (IN)

( * ) Notice: Subject to any disclaimer, the term of this patent is extended or adjusted under 35 U.S.C. 154(b) by 0 days. days.

(21) Appl. No.: 15/176,205

(22) Filed: Jun. 8, 2016

(65) Prior Publication Data

US 2017/0224088 A1 Aug. 10, 2017

(30) Foreign Application Priority Data

Feb. 8, 2016 (IN) ..... 201621004329

(51) Int. Cl.

| | |
|---|---|
| ***B05C 1/00*** | (2006.01) |
| ***A45D 40/02*** | (2006.01) |
| ***B43K 29/00*** | (2006.01) |
| ***A45D 40/24*** | (2006.01) |
| *A45D 40/00* | (2006.01) |

(52) U.S. Cl.

CPC ..... *A45D 40/02* (2013.01); *A45D 40/24* (2013.01); *B43K 29/00* (2013.01); *B43K 29/004* (2013.01); *A45D 2040/0025* (2013.01)

(58) Field of Classification Search

CPC ..... B43K 29/00; B43K 29/004
USPC ..... 401/17–19, 195
See application file for complete search history.

(56) References Cited

U.S. PATENT DOCUMENTS

| | | | | |
|---|---|---|---|---|
| 5,927,880 | A * | 7/1999 | Allison | A63F 3/06 401/17 |
| 6,200,045 | B1 * | 3/2001 | Hahn | A45D 34/06 401/126 |
| 6,276,853 | B1 * | 8/2001 | Breidenbach | A45D 40/24 401/17 |
| 6,688,792 | B1 * | 2/2004 | Reichmann | B43K 27/08 401/18 |
| 8,434,955 | B2 * | 5/2013 | Rauschert | A45D 40/24 401/17 |
| 9,004,791 | B2 * | 4/2015 | Acierto | A45D 34/04 401/17 |
| 2006/0165470 | A1 * | 7/2006 | Gerules | B43K 23/06 401/18 |

* cited by examiner

*Primary Examiner* — Jennifer C Chiang

(57) ABSTRACT

A connecting element with a dual engaging means that allows two different items of daily use to be connected together as a single article for the day to day convenience of the user is disclosed. The connecting element has the dual engaging means to secure two articles at a time. The connecting element is used as an engaging means and also as a closing means for respective articles. The connecting element has different geometric features at its either ends so that it is used as an engaging means and a closing means for the articles with different geometric features.

18 Claims, 5 Drawing Sheets

CONNECTING ELEMENT WITH DUAL ENGAGING MEANS

CROSS-REFERENCE TO RELATED APPLICATIONS AND PRIORITY

The present application does claim priority from Indian patent application number 201621004329 filed on 8 Feb. 2016.

TECHNICAL FIELD

The present subject matter in general relates to a mechanical component employed to connect two different articles and at the same time maintaining their individual geometric features and providing an airtight environment.

BACKGROUND

Push-up tubes have become increasingly popular in stationary and cosmetics industry. The major role of these push up tubes is to deliver the sticky substance to a targeted surface and at the same time preventing that such substance does not come in contact with the hands/fingers of the user. Two successful implementations of the push-up tubes are lipsticks and glue sticks.

Most of the times these objects are rendered useless before they are used in their entirety. This happens due to various reasons. One being that the closing means of such objects are usually small and often rollable and they are often misplaced and not re-engaged with the body of the object. The usable life of the object is reduced if they have a missing closing means.

It is always desirable to make our daily use articles as multipurpose. First of all, a multipurpose object save storage space especially in an environment where efficient use of space is desirable like an office desk, pen stand, hand bags or a dressing table. Secondly, such a multipurpose article is less likely to misplaced, since its frequency of use of the multipurpose article is increased.

Two of most frequently used stationary items are glue stick and highlighter. Today these two items are separately available in market. Now there exists no motivation to combine these different articles, since, though they are used in the same set ups, their requirements with respect to the closure caps are unique. The Glue stick closure cap is required to be circular or triangular depending on the shape of the stick, the cap is required to enclose the stick without coming in contact with the glue. Whereas the highlighter cap is required to maintain an airtight chamber after closure of the cap since the highlighter ink is highly evaporable and has to have an airtight closure mechanism. The highlighter pens need to be closed with air tight cap because any contact with air vaporise the ink and the pen will go dry. Many times the ink dries up if the cap is loose or if the cap gets misplaced.

Yet another problem that exists especially with glue sticks is their undesirable placement in a Pen Holder/stand. A Pen holder is generally at least 4 inches high, this is because it is meant to rest general stationary items like Pen, pencils, scissors, cutters, highlighter pens and highlighters which are usually no less than 5 inches long. Shorter height of the pen holder allows the stationary items to rest within the pen holder and also project out and lean on the side wall of such pend holder, which makes them easily visible and allows them to be picked up conveniently by the user. At the same time the glue-stick which is also a stationary article used within the same set up is no longer than 2.75 to 3.5 inches.

The shorter height of the glue stick allows it to assume a horizontal position in a pen holder thereby not only preventing the other stationary items to rest at the base, but making it difficult for the user to pick it up as the user has to take out all other article before he is able to catch hold of the glue stick.

Besides while the glue stick and highlighter are separate items, the user has to take care of two different items and it increases the inventory of stationary to be maintained. Moreover, one needs to be very organised with the caps of these items since the small/rollable caps are readily misplaced and being careless in capping the items will render the item useless. Such problem may be also experienced with other consumable items. For e.g. cosmetics a lipstick and eyeliner are frequently used cosmetic products. Also a lip gloss and lip liner are frequently used and possess similar set of technical problems.

What is needed is an integrated model of two frequently used consumable articles. The integration has to be such that it facilitates greater speed of work, prevents one being stranded in the middle of a job because one of the article is not available.

The present subject matter is directed to an apparatus which solves above problems. Other objects, advantages and novel features will become apparent from the following detailed description of the subject matter when considered in conjugation with appended drawings.

SUMMARY

Before the present apparatus and its components are described, it is to be understood that this disclosure is not limited to the particular apparatus and its arrangement as described, as there can be multiple possible embodiments which are not expressly illustrated in the present disclosure. It is also to be understood that the terminology used in the description is for the purpose of describing the particular versions or embodiments only, and is not intended to limit the scope of the present application. This summary is not intended to identify essential features of the claimed subject matter nor is it intended for use in detecting or limiting the scope of the claimed subject matter.

In one aspect, the present subject matter pertains to a connecting element which has dual engaging means to secure two articles for example, lipstick, glue stick, lip balm at one end and highlighter, eyeliner, lip pencil, white board or permanent marker or correction fluid pen at other end; such a connecting element provide airtight closing means on one end and a circular closing means on the other end, wherein the airtight closure end engages the article in upright as well as an inverted position.

In another aspect, the present subject matter pertains to a highlighter comprising of a peripheral recess on both the ends of marking elements and a circular groove on opposite end of the highlighter so that it can be engaged with a connecting element in upright and inverted position also the circular groove and recess provide a locking arrangement that prevents the highlighter from popping out of the connecting element when in use.

It is a primary object of this subject matter to disclose a connecting element that allows two different articles to be attached together for convenience of day to day user.

It is a further objective of this subject matter to disclose an accessory combining glue stick and highlighter which have reservoirs filled with quantities of glue and highlighting ink that are in proportion to each other.

It is still a further objective of this subject matter to disclose a single closing means for two different articles. It is difficult to lose the closing means of the glue stick of the present subject matter since unlike the regular glue stick caps which are cylindrical thus more likely to roll away and forgotten as compared to the connecting element of the present subject matter which is bigger and heavier and also engages another element like a highlighter that enables such element to be placed in an upright thus preventing chances for rolling.

These and other features, aspects, and advantages of the present subject matter will become better understood with reference to the following description and appended claims.

BRIEF DESCRIPTION OF DRAWINGS

The detailed description is described with reference to the accompanying Figures. In the Figures, the left-most digit(s) of a reference number identifies the Figure in which the reference number first appears. The same numbers are used throughout the drawings to refer like features and components.

DETAILED DESCRIPTION

Figure 1:
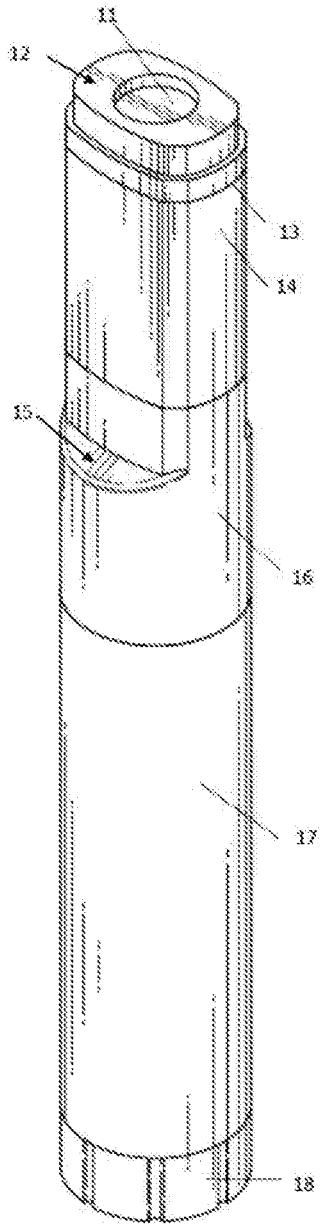
FIG. 1 illustrates complete assembly of highlighter and glue stick with the highlighting element being engaged in inverted position, in accordance with various embodiments of the present subject matter.

The present subject matter relates to a multipurpose device and method of coupling of two articles together with the help of a connecting element. Referring to FIG. 1, a complete assembly of highlighter and glue stick with the highlighting element being engaged in inverted position is shown, in accordance with an embodiment of the present subject matter. As shown in FIG. 1, a connecting element 16 is used to couple a glue stick 10 and a highlighter 19 without changing the design features of a glue stick or of the highlighter as shown in FIG. 1. It is to be noted that though throughout the specification, reference has been made to the glue stick 17 and the highlighter 14 in order to explain the present subject matter, however, the glue stick 17 may be replaced with a lipstick, glue stick or a lip balm whereas the highlighter 14 may be replaced by a highlighter for use in cosmetics, eyeliner or a lip pencil without deviating from the scope of the present subject matter.

Figure 3:
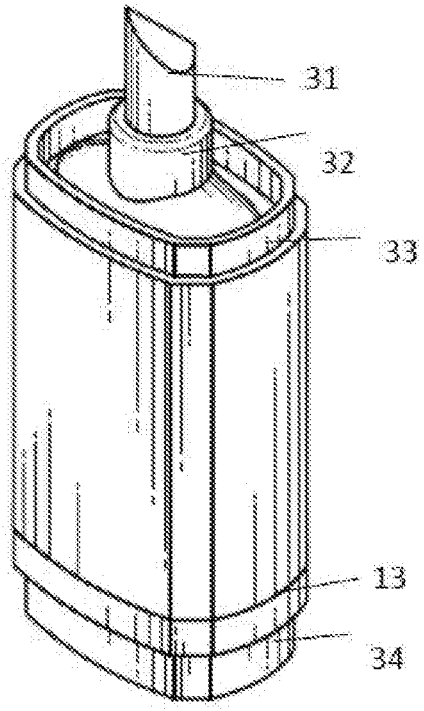
FIG. 3 illustrates the elements of the highlighter, in accordance with an embodiment of the present subject matter.

As shown in FIG. 1, the highlighter 19 is an assembly of four sub elements namely, a plug 11, a reservoir (not shown in FIG. 1), a housing 14 and a tip 31 (as shown in FIG. 3). The plug 11 indicates the bottom end of the highlighter. The reservoir is adapted to store the evaporable ink, i.e. consumable body. The housing 14 is the one in which the reservoir is held. The plug 11 and the housing 14 is joined with an ultra-sonic sealing method. The joint 13 is visible to naked eye. As shown in FIG. 3, the reservoir has a cylindrical protrusion 32 which houses the tip 31 of the highlighter. The tip 31 (shown in FIG. 3) of the highlighter 19 (shown in FIG. 1) indicates top end of the highlighter 19 and is made of a porous material. The highlighter 19 (shown in FIG. 1) is typically manufactured in a rectangular shape with curved edges. The shape is ergonomic and facilitates easy marking with the help of a cut tip.

Now again referring to FIG. 1, the glue stick 10 assembly is made of four sub elements namely, a screw 18, an elevator (not shown), stick of glue (not shown), and a glue stick housing 17. The screw 18 is rotated to raise or fall the elevator and in turn the stick of glue sitting on the elevator gets raised or falls. The housing for the consumable body, i.e. glue stick housing 17, covers the stick of glue. The glue stick 10 is typically manufactured in a circular shape. This aids the uniform gluing of targeted area.

To maintain the unique design features of a glue stick 10 and of highlighter 19 (shown in FIG. 1), the connecting element 16 (shown in FIG. 1) is manufactured in a manner such that it acts as a closing means for the glue stick 10; it acts as a closing means for the highlighter 19 when it is not in use and when it is put in use the connecting element 16 acts as a seating support to hold the highlighter 19.

To achieve this, the connecting element 16 (as shown in FIG. 1) has one end that acts as a closing means to the glue stick 10 manufactured circular in shape. The other end that acts as a sealing means and engaging means for highlighter 19 has a rectangular shape with curved edges. The circular and rectangular portions of the connecting element 16 are joined by a sloping profile 15. This portion acts like a holding or gripping means for user when the user wants to use the highlighter 19.

Figure 2:
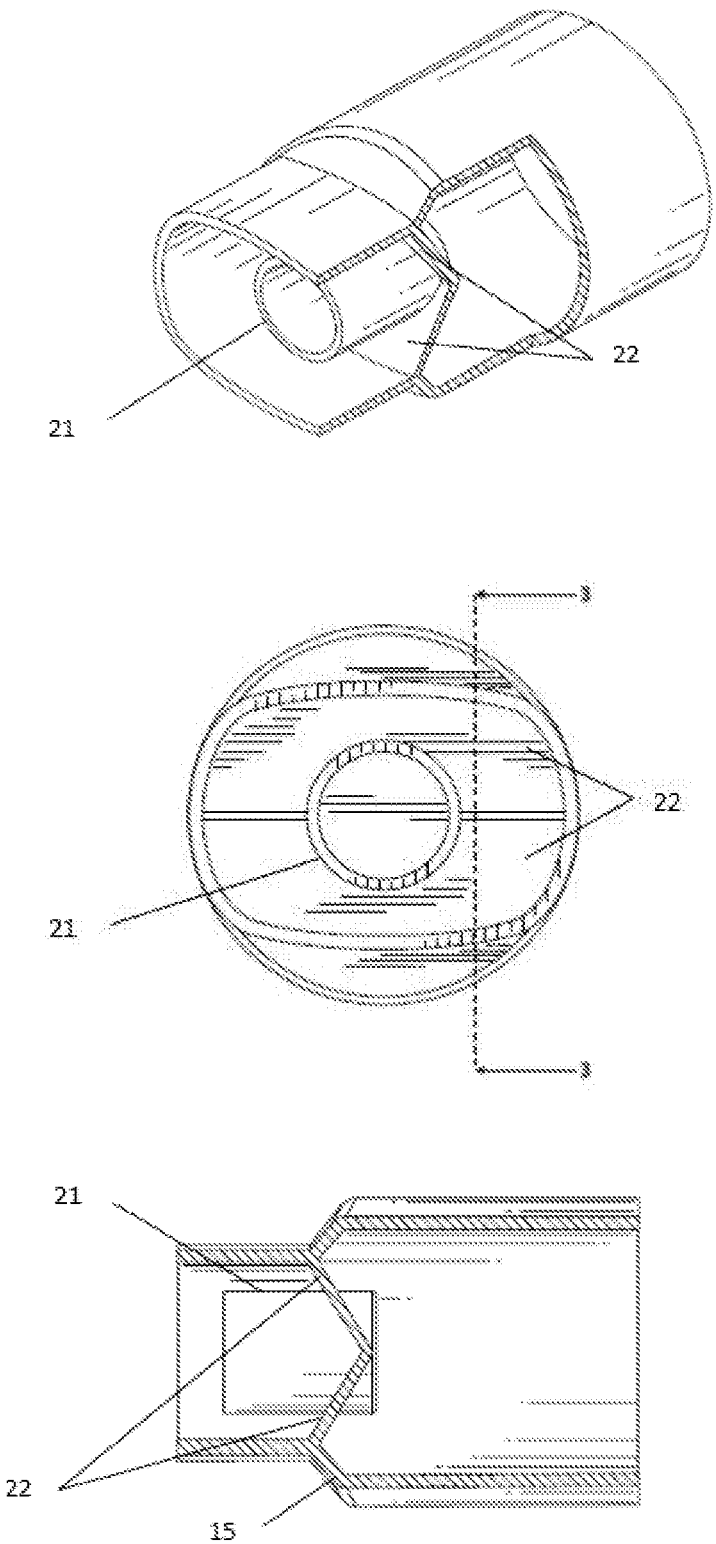
FIG. 2 illustrates a connecting element with perspective view and top view, in accordance with an embodiment of the present subject matter.

The connecting element 16 is further explained by referring to FIG. 2. The connective element 16 is essentially a hollow tubular mould consisting of a partition 22, shown in FIG. 2, that separates the circular and rectangular part. As shown in FIG. 2, this partition 22 serves to eliminate various problems. It isolates the two articles from each other. It creates an air tight chamber when engaging with the top end of the highlighter 19 (shown in FIG. 1). The partition 22 is designed in a conical shape to prevent thermal stresses while casting of the element. A cylindrical groove 21 (shown in FIG. 2) is introduced in this conical partition in which the tip 31 (shown in FIG. 3) of the highlighter 19 (shown in FIG. 1) will be rested. This end of the connecting element 16 thus acts as a closing means for the highlighter 19 shown in FIG. 1. The cylindrical groove 21 (shown in FIG. 2) has an interference fit with the holder of the highlighter tip 31 (shown in FIG. 3). This protects the highlighter tip 31 (shown in FIG. 3) and it is also employed as an additional measure for preventing the evaporation of the highlighter ink.

To test the airtightness percentage, a standard airtightness test was performed on a working sample of the current multipurpose device. The standard airtightness test involved a specific process that was continued for 7 days. The airtight compartment was filled up to nominal capacity with 50% IPA (Isopropyl Alcohol) water (50% IPA+50% water) at ambient temperature and proper fitment of closing means was ensured. Any droplets present on the sample were wiped out. The samples were conditioned at 50° C. in oven for 2 hours. When removed they were allowed to cool to ambient temperature and after that weighed accurately. For a second time the samples were kept in oven but for 24 hours and 50 deg temperature. When removed they were allowed to cool and weigh and this process was repeated for 7 days. The results for this test are tabulated below:

Performance Observations Airtightness (Loss %)

| Test | Initial Sample Losses in % | Final Sample Losses in % |
|---|---|---|
| IPA | 7.6% | 1.8% |
| Product (one month) | 2.4% | 0.35% |

The maximum loss calculated for 7 days & did not exceed 2%. Thus the final design of the device was optimized.

Figure 4:
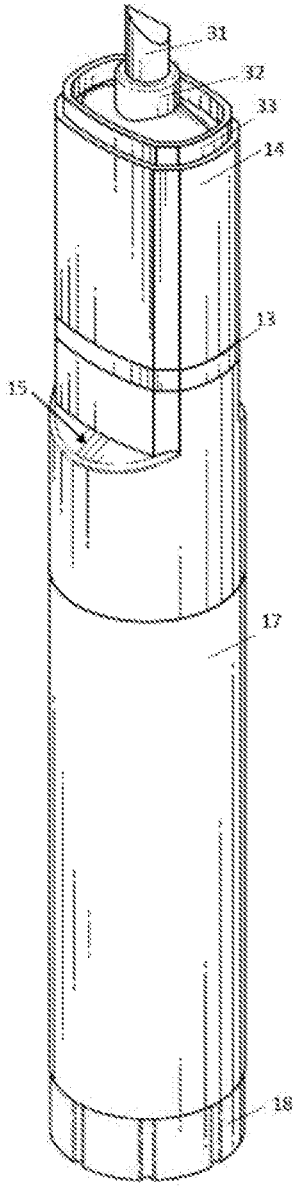
FIG. 4 illustrates complete assembly of highlighter and glue stick with the highlighting element being engaged in an upright position, in accordance with an embodiment of the present subject matter.
Figure 5:
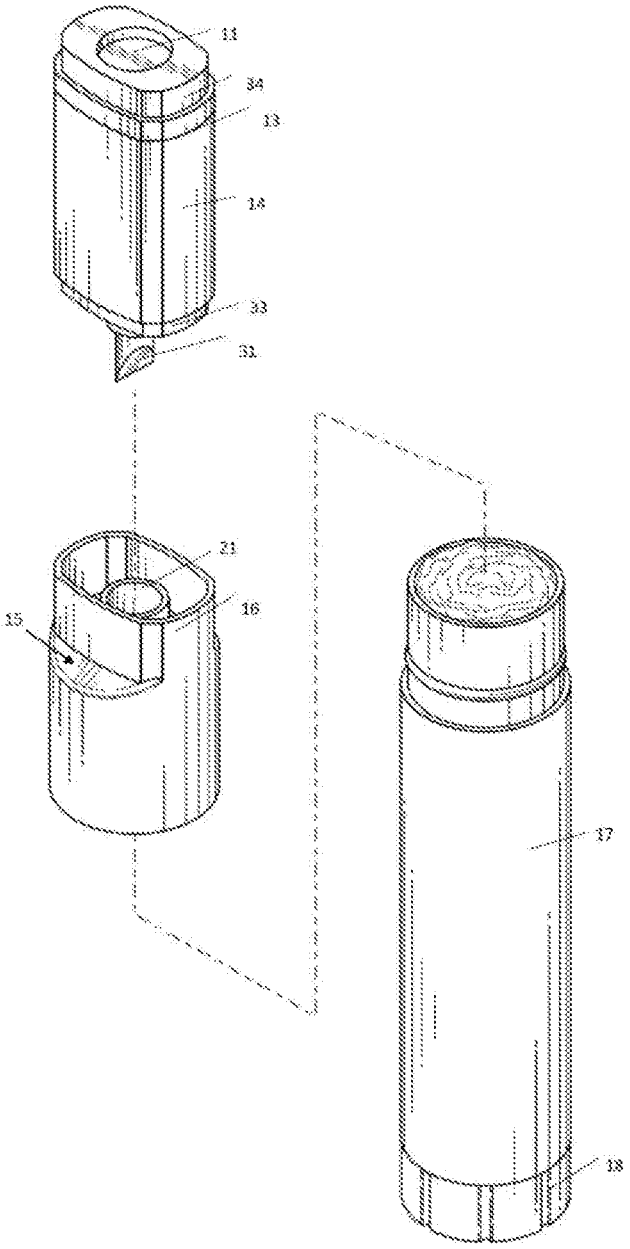
FIG. 5 illustrates exploded view of the highlighter and the glue stick, in accordance with an embodiment of the present subject matter.

In one embodiment of the subject matter, the end of the connecting element 16 which acts as a closing means and engaging means for highlighter 19 has rectangular shape with curved edges, as shown in FIG. 1. It has interference fit with the bottom end of the highlighter 19. The bottom end of the highlighter 19 (shown in FIG. 1) has a recess 34 (shown in FIG. 3) which fits into the connecting element 16. The depth of the recess equals to the depth available between the rectangular edges of connecting element 16 (shown in FIG. 1) and the conical shape of partition 22 (shown in FIG. 2). A click sound assures the user that the highlighter 19 is secured in the groove. Once secured the highlighter 19 can be held in natural pen like orientation as shown in FIG. 4. As shown in FIG. 5, the exploded view shows that the top end of the highlighter 19 also has similar recess 33 by which it can be secured with the connecting element 16 when not in use.

As shown in FIG. 1, the flat bottom end surface 12 of the highlighter 19, that is also the highlighter plug 11 surface has a circular groove in which has an interference fit with the cylindrical groove 21 present in the conical partition 22 which are shown in FIG. 2. This arrangement insures that the highlighter 19, shown in FIG. 1, does not slip when it is engaged in a position to enable writing.

In the initial stages of model design, referring to FIG. 3, the depth of peripheral recess available on the top end 33 and the bottom end 34 of the highlighter 19, shown in FIG. 1, was 2.5 mm. It was found during model testing that the highlighter 19 would frequently pop out of the connecting element 16. This problem was solved by increasing the depth of the peripheral recess from 2.5 mm to 3.7 mm. This modification in the original design optimized the model. Greater depth of recess prevents the highlighter 19 from popping out of the connecting element 16.

The quantity of glue available in the glue stick 10 lasts for four to six months' time. The quantity of ink in the reservoir of the highlighter 19 is 3 ml. The amount of ink with given cut tip 31, shown in FIG. 3, will write up to 100 meters. The life of the glue stick 10 and the highlighter 19 (shown in FIG. 1) is proportional.

The bottom of the glue stick 10 and the bottom of the highlighter 19 have flat end surfaces. This enables the item to be supported in upright position when not in use.

The connecting element 16 in this subject matter is novel in all means. It serves as a closing means for both the glue stick 10 and highlighter 19 and as an airtight sealing for the highlighter 19; also it serves as an engaging means for highlighter 19 when it is put in use.

The connecting element 16 is made of thermoplastic. It has high strength-to-density ratio. The present embodiment is manufactured with High-density polyethylene (HDPE), Polypropylene (PP) or Random Copolymer Polypropylene (PPCP). Future embodiment may consist Thermoplastic elastomers (TPE).

The ink used in highlighter 19 is highly evaporable. The connecting element 16, when it acts as a cap for highlighter 19, it provides an airtight sealing. This will prevent the air or moisture contact with the tip 31 (shown in FIG. 3) of the highlighter 19 and prevents the ink from getting evaporated. To make one end of the connecting element 16 function as airtight sealing it has special features. It has interference fit with the top end of highlighter 19. It has a conical shape partition 22 which holds a cylindrical groove 21 (shown in FIG. 2) in which the tip 31 (shown in FIG. 3) of highlighter fits. The combination of conical shape partition 22 (shown in FIG. 2) and tight fit of tip 31 (shown in FIG. 3) in the groove acts as an airtight sealing. This was proved with standard airtightness test.

Another embodiment of this subject matter is a holder on the highlighter 19, shown in FIG. 1, so that it can be easily carried around in pockets.

In yet another embodiment the highlighter is refillable with ink.

The preceding description has been presented with reference to various embodiments of the subject matter. Persons skilled in the art and technology to which this subject matter pertains will appreciate that alterations and changes in the described article and its components can be practiced without meaningfully departing from the principle, spirit and scope of this subject matter.

The invention claimed is:

1. A connecting element with two ends, wherein one end is adapted to act as a closing means for a first article and other end is adapted to act as an airtight sealing and engaging means for a second article, wherein the two ends are having distinct geometrical features, and wherein the two ends are further separated by a conical partition holding a cylindrical groove, wherein the conical partition along with the cylindrical groove is further adapted to provide the airtight sealing to a tip of the second article in an inverted position and an interference fit with the second article in an upright position.

2. A connecting element as claimed in claim 1 wherein, the first article is a lipstick, glue stick or a lip balm.

3. A connecting element as claimed in claim 1 wherein, the second article is a highlighter, eyeliner or a lip pencil.

4. A connecting element as claimed in claim 1 wherein the engaging means is capable of engaging the second article in upright as well as inverted position.

5. A connecting element as claimed in claim 1 adapted to, engaging two different articles in a way that their central axes coincide and the articles remain distinct from each other.

6. A multipurpose device as claimed in claim 1, wherein the connecting element is adapted to engage with a peripheral recess on both the ends of a rectangular housing with curved edges of the second article in the upright as well as the inverted position.

7. A multipurpose device as claimed in claim 6, wherein the rectangular housing comprises of a circular groove on bottom end surface in a way that it has a tight fit with the cylindrical groove in the connecting element thereby preventing the second article from popping out of the connecting element when in use.

8. A multipurpose device that comprises a glue stick and a highlighter engaged longitudinally by means of a connecting element characterized in that the connecting element has two ends wherein the two ends are having distinct geometrical features, and wherein the two ends are further separated by a conical partition holding a cylindrical groove, wherein one end acts as a closure cap of the glue stick and other end acts as an airtight sealing cap of for the tip of the highlighter wherein the conical partition along with the cylindrical groove is further adapted to provide the airtight sealing to a tip of the highlighter in an inverted position and an interference fit with the highlighter in an upright position.

9. A multipurpose device as claimed in claim 8, wherein the highlighter comprises of: a peripheral recess on both the ends of rectangular housing with curved edges to engage with the connecting element in the upright as well as the inverted position.

10. A multipurpose device as claimed in claim 8 wherein, the device has a total height of at least 5 inches.

11. A multipurpose device as claimed in claim 8, wherein the connecting element is adapted for engaging the glue stick and the highlighter in a way that their central axes coincide and the articles remain distinct from each other.

12. A multipurpose device as claimed in claim 8, wherein a highlighter housing comprises of a circular groove on bottom end surface in a way that it has a tight fit with the cylindrical groove in the connecting element thereby preventing the highlighter from popping out of the connecting element when in use.

13. A multipurpose device that comprises a glue stick and a highlighter engaged longitudinally by means of a connecting element characterized in that the connecting element has two ends wherein one end acts as a closure cap of the glue stick and other end acts as an airtight sealing cap of for the tip of the highlighter, and wherein a highlighter housing comprises of a circular groove on bottom end surface in a way that it has a tight fit with a cylindrical groove in the connecting element thereby preventing the highlighter from popping out of the connecting element when in use.

14. A multipurpose device as claimed in claim 13, wherein the connecting element is adapted for engaging the glue stick and the highlighter in a way that their central axes coincide and the articles remain distinct from each other.

15. A multipurpose device as claimed in claim 14, wherein the highlighter comprises of: a peripheral recess on both the ends of the highlighter housing with curved edges to engage with the connecting element in the upright as well as the inverted position.

16. A multipurpose device as claimed in claim 15, wherein the two ends are having distinct geometrical features, and wherein the two ends are further separated by a conical partition holding a cylindrical groove.

17. A multipurpose device as claimed in claim 16, wherein the conical partition along with the cylindrical groove is further adapted to provide the airtight sealing to a tip of the highlighter in the upright position and an interference fit with the highlighter in the inverted position.

18. A multipurpose device as claimed in claim 17, wherein the device has a total height of at least 5 inches.

* * * * *